United States Patent [19]

Arita et al.

[11] 4,437,950

[45] Mar. 20, 1984

[54] METHOD OF CONTROLLING ALUMINUM ELECTROLYTIC CELLS

[75] Inventors: Yoji Arita; Yuzo Seo, both of Yokohama, Japan

[73] Assignee: Itsubishi Keikinzoku Kogyo Kabushiki Kaisha, Tokyo, Japan

[21] Appl. No.: 321,781

[22] Filed: Nov. 16, 1981

[51] Int. Cl.[3] ..... C25C 3/06; C25C 3/20

[52] U.S. Cl. ..... 204/67

[58] Field of Search ..... 204/67, 243 R

[56] References Cited

U.S. PATENT DOCUMENTS 3,391,074 7/1968 Chambran ..... 204/67

3,900,371 8/1975 Chaudhuri ..... 204/67

*Primary Examiner*—Howard S. Williams

*Attorney, Agent, or Firm*—Oblon, Fisher, Spivak, McClelland & Maier

[57] ABSTRACT

Increase or decrease in a quantity of alumina presenting in a bath or a metal in an aluminum electrolytic cell is detected and a quantity of electric power supplied to the cell is increased or decreased in accordance with the result of detection. The detection is made by calculating a difference between a quantity of alumina supplied to the cell during an interval between an instant at which a previous anode effect has occurred or was anticipated to occur and an instant at which a present anode effect occurs or is anticipated to occur, and the quantity of alumina consumed during the interval.

6 Claims, No Drawings

METHOD OF CONTROLLING ALUMINUM ELECTROLYTIC CELLS

BACKGROUND OF THE INVENTION

This invention relates to a method of controlling an aluminum electrolytic cell, and more particularly a method of stably operating an aluminum electrolytic cell while maintaining the temperature thereof at a constant value.

As is well known in the art, aluminum is prepared by electrolytically reducing alumina in an electrolytic bath consisting mainly of cryolite. Since the alumina dissolved in the electrolytic bath is consumed as a result of an electrolytic reaction it is necessary to continuously, or at a definite interval feed alumina into the electrolytic bath. When the concentration of alumina in the electrolytic bath decreases below a certain critical limit, a so-called anode effect phenomenon appears in which the voltage of the electrolytic cell rapidly rises to 30 to 50 V. While the anode effect persists, since the normal electrolytic reaction is impaired, it is necessary to supply alumina to eliminate the anode effect. Though the anode effect can be taken as an index for supplying alumina, it accompanies a power loss, increases the job, and causes dispersion and evaporation of fluorides into surrounding atmosphere. For this reason, it has been the common practice to prevent the occurrence of the anode effect by continuously, or at a predetermined interval, supplying alumina or by supplying alumina by anticipating the occurrence of the anode effect so as to limit the frequency of occurrence of the anode effects to a permissible number.

It is advantageous to operate an electrolytic cell at a constant temperature because overheating thereof results in a decrease in the current efficiency. Moreover, as the thickness of a so-called self-lining layer formed on the wall of the electrolytic cell in contact with the electrolytic bath due to solidification thereof decreases or disappears with the result that molten electrolytic bath comes into direct contact with the wall surface of the cell thus corroding the wall surface and shortening the operating life of the electrolytic cell.

Conversely, too low temperature of the electrolytic bath increases the thickness of the self-lining to disturb supply of alumina and taking out of the formed aluminum. This also decreases the solubility of alumina so that the alumina supplied would sink and deposit on the bottom of the electrolytic cell without being dissolved. Consequently, the concentration of the alumina dissolved in the electrolytic bath decreases thereby causing frequent anode effect. As above described, too high and too low electrolytic cell temperatures result in troubles.

The temperature of the electrolytic cell during the operation is determined by an electric energy supplied thereto. On the other hand, since the current of respective electrolytic cells belonging to the same pot-line is the same and substantially constant, the temperatures of respective cells are determined by respective cell voltages. Each cell voltage varies depending upon the distance between the bottom surface of an anode electrode and the upper surface of molten aluminum in each electrolytic cell, that is the interpolar distance, and the cell voltage increases with the interpolar distance. Consequently, it is possible to maintain the bath temperature at a substantially constant value by measuring the bath temperature and by raising the anode electrode to increase the interpolar distance where the bath temperature decreases below a standard value and vice versa.

However, measurement of the bath temperature utilized in such control is relatively difficult. In an aluminum electrolytic factory, since several tens or several hundreds of electrolytic cells are operated simultaneously, it is not only expensive to install independent temperature measuring devices for all cells but also increases the cost and labor of maintenance and inspection of such large number of temperature measuring devices.

We have made investigations to find out a novel method of maintaining the temperature of an electrolytic bath at a constant value by adjusting the quantity of electric power supplied to the cell based on a readily obtainable index without directly measuring the temperature of the electrolytic cell and found that the temperature of the bath can be maintained at a constant value and the operation of the cell can be stabilized where the electric power supplied to the electrolytic cell is adjusted in accordance with the variation in the quantity of alumina presenting in the aluminum electrolytic bath or a metal in a solid state.

SUMMARY OF THE INVENTION

Accordingly, it is an object of this invention to provide an improved method of controlling an aluminum electrolytic cell capable of operating it stably while maintaining the cell temperature at a constant value.

Another object of this invention is to provide a novel method of controlling an aluminum electrolytic cell capable of maintaining the cell temperature at a relatively low value thus increasing the yield of aluminum per unit electric power by accurately and readily determining the temperature condition of the cell.

According to this invention there is provided a method of controlling an aluminum electrolytic cell comprising the steps of detecting increase or decrease in a quantity of alumina presenting in a bath or a metal in said electrolytic cell in a solid state, and increasing or decreasing a quantity of electric power supplied to said electrolytic cell in accordance with the result of detection.

DESCRIPTION OF THE PREFERRED EMBODIMENTS

A preferred embodiment of this invention will now be described in detail. As above described, during the operation of an aluminum electrolytic cell, alumina of a quantity a little less than that consumed by electrolysis is usually supplied continuously or intermittently to the cell so as to limit the interval of occurrence of the anode effect to a predetermined value. The anode effect occurs when the concentration of alumina in the electrolytic bath decreases below a certain critical limit. Accordingly, when the total quantity of alumina fed into the cell dissolves immediately in the electrolytic bath, the interval of occurrence of the anode effect could be made to be constant. Actually, however, it is almost impossible to control the interval of occurrence of the anode effect to a constant value. Because, the specific gravity of alumina is larger than those of the electrolytic bath and of molten aluminum so that a portion of the supplied alumina precipitates and deposits on the bottom of the electrolytic cell without being dissolved. Furthermore, supply of alumina causes decrease in the temperature of the electrolytic bath so that a self-lining containing a large quantity of alumina would grow on the wall surface of the electroytic cell. These phenomena become remarkable especially when the electrolytic cell is operated at a relatively low bath temperature for the purpose of increasing the current efficiency because low bath temperature decreases the solubility of alumina into the electrolytic bath. For this reason, even when the quantity of alumina supplied is commensurate with or equal to that of the alumina consumed at a certain time, when the temperature of the bath is low the quantity of alumina in a solid state in the electrolytic cell increases, thus decreasing the concentration of the alumina in the electrolytic bath which causes an anode effect. On the other hand, when the temperature of the bath increases the alumina presenting in the cell in the solid state dissolves therein to increase the concentration of alumina in the bath which is effective to decrease the number of occurrences of the anode effects. This invention is based on the unique utilization of this phenomenon. More particularly, according to this invention increase or decrease in the quantity of alumina presenting in the cell in the solid state is utilized to adjust the quantity of electric power supplied to the bath. Since increase in the alumina quantity means a low temperature of the electrolytic bath, the anode electrode is raised to increase the power supply. Conversely, since decreases in the alumina quantity means a high bath temperature, the anode electrode is lowered to decrease power supply.

Variation in the alumina quantity presently in the electrolytic cell in the solid state can be readily calculated by utilizing the fact that the anode effect occurs when the alumina concentration in the bath reaches a certain critical value. More particularly, by calculating the quantity of alumina supplied to the electrolytic cell between a time at which previous anode effect has occurred or was anticipated to occur and a time at which present anode effect occurs or is anticipated to occur and the quantity of alumina electrolyzed during this interval, the difference between these calculated values represents an increase in the alumina quantity presenting in the solid state.

Where the quantity of the electrolytic bath varies in the interval between the previous time and the present time, the quantities of alumina in the bath in a dissolved state at both times also vary, thus influencing the quantity of alumina presenting in the solid state. Consequently, to perform accurate control it is necessary to take into consideration also the variation in the quantity of the electrolytic bath at the time of calculating the variation in the alumina quantity presenting in the solid state. However, since the alumina concentration in the bath at a time at which an anode effect occurs actually or anticipated to occur is low, the effect of the variation in the bath quantity upon the calculation is relatively slight so that even when the method of this invention is worked out by neglecting such a small influence, the operation of the cell can be stabilized and the variation in the bath quantity can be decreased meaning lesser influence upon the calculation caused thereby. In other words, the method of control of this invention can be worked out without considering a variation in the bath quantity.

The quantity is alumina supplied can be readily calculated by weighing it by a weighing device installed in an alumina supply station, while the quantity of alumina consumption can be calculated according to the following equation.

$$\text{Quantity of alumina consumption (Kg)} = \frac{\text{electric quantity (amp} \cdot \text{hour)} \times 3600 \times 102 \times 10^{-3}}{6 \times 96500} \times \frac{\text{current efficiency (\%)}}{100}$$

The electric quantity can be calculated by integrating current. Under a normal operating condition, since variation in the current value is small, it is possible to use the product of an average current value and the time elapsed as the electric quantity. Usually, variation in the current efficiency is also small so that its average value can be advantageously used. Consequently, the quantity of alumina consumption can be conveniently determined by multiplying a time elapsed with a predetermined constant.

When it is noted that the quantity of alumina presenting in the electrolytic bath or the metal in the solid state has increased, the anode electrodes are raised to increase the interpolar distance thereby increasing the electric power supply, the amount of increase thereof being determined by the heat quantity necessary to heat an increased quantity of detected alumina presenting in the solid state from the temperature of the alumina supplied to the temperature of the bath and to dissolve the supplied alumina.

The minimum quantity of the increase in the power supply corresponds to the heat quantity necessary to heat up the increased quantity of the alumina from its supply temperature to the bath temperature. When the quantity of the electric power is lesser than the minimum quantity it is impossible to perfectly compensate for the heat quantity absorbed by the increased quantity of the solid state alumina. Consequently, it is impossible to sufficiently recover decreased temperature of the electrolytic bath causing a vicious cycle of the occurrence of the anode effect due to poor solubility of the alumina caused by a low bath temperature and temperature lowering of the bath caused by a temporal supply of alumina performed for the purpose of eliminating the anode effect.

The maximum quantity of the increase in the electric power supply corresponds to the heat quantity necessary to heat up the increased quantity of the alumina to the bath temperature and to dissolve it in the bath. Supply of electric power exceeding the maximum quantity is dangerous because it overheats the bath.

The quantity of increase of electric power supplied is determined to a suitable value between the maximum and minimum values described above. The heat quantity necessary to heat 1 Kg of alumina from room temperature to the bath temperature amounts to about 300 kilocalories, while the heat quantity necessary to dissolve 1 Kg of alumina in the bath amounts to about 500 kilocalories. It is desirable to quickly increase or decrease the quantity of electric power. Thus, it is most desirable to calculate increase or decrease in the quantity of alumina presenting in the electrolytic bath or the metal in the solid state immediately after occurrence of the anode effect, such variation in the quantity of alumina corresponding to the difference between the quantity of alumina supplied after occurrence of a previous anode effect and the quantity of alumina consumed during this interval, and to increase or decrease the electric power supply based on the calculated value. In this case, increase in the electric power should be completed before an instant at which the next anode effect occurs or is anticipated to occur. In other words, according to the method of this invention, as a basic concept, a deficiency of the electric power during an interval between the previous and present anode effects is compensated for or supplemented before the next anode effect occurs. More particularly, according to the method of this invention, when an anode effect is eliminated, electric power larger than a quotient obtained by dividing the increased quantity of the power supply by an average time between two consecutive anode effects is added to a standard quantity of power supply, and when supply of such surplus power is completed, the quantity of the electric power supply is returned to the standard value. The surplus power added to the standard power may be constant with time or may be large initially and then decrease gradually with time. Alternatively, the following simplified method may be used although the efficiency is slightly lower than the preferred method described above. More particularly, at each definite interval, for example 24 hours, the quantity of alumina presenting in the bath or the metal in the solid state during this interval is determined and the quantity of the electric power is varied based on the result of determination.

For example, it is possible to calculate, at each 24 hours, the increment per unit time of the quantity of alumina presenting in the bath in the solid state based on an anode effect occurred most recently and an anode effect occurred just prior to that anode effect (where the anode effect occurs more than 3 times during the 24 hours the calculation may be made starting from much earlier anode effect) and a quantity of electric power corresponding to the increment is added to the standard quantity of electric power per unit time thereby supply the sum for the next 24 hours. According to this method, it becomes possible to adjust the electric power at each 24 hours.

While foregoing description concerns a case wherein the quantity of alumina presenting in the bath or the metal in the solid state has increased, where the quantity of alumina decreases, the power supply is decreased in the same manner as above described. In the latter case, however, it is advantageous to make constant (with time) the quantity of electric power to be decreased.

Increase or decrease in the electric power is effected by increasing or decreasing the interpolar distance. However, increase in the interpolar distance should be effected within a limit in which the anode electrode is not completely drawn out of the electrolytic bath. On the other hand, excessive decrease in the interpolar distance rapidly decreases the current efficiency. In this case, even though the interpolar distance has been decreased and thus power supply has also been decreased, that absorption caused by reaction decreases at a higher rate to raise the bath temperature. For this reason, decrease in the interpolar distance is limited for a case in which there is a margin for the interpolar distance, and even in such a case, the decrease in the interpolar distance should be performed carefully. Since the calculation of the increase and decrease in the quantity of alumina presenting in the solid state accompanies more or less error, it is advantageous to adjust the interpolar distance only when the variation in the quantity of alumina exceeds a predetermined value.

One example of an adequate method of control is a method wherein the control is effected by taking as a standard a state in which the power supply becomes a little deficient as a result of the decrease in the interpolar distance. With this method of control, the quantity of alumina presenting in the bath or the metal in the solid state always tends to increase. Consequently, after extinguishing an anode effect the electrolytic cell is operated with an increased interpolar distance related to the detected value of an increase in the alumina quantity and the operation is continued by resuming the original interpolar distance when supply of surplus electric power is completed. With this method of control, since the control is always performed tending to increase the interpolar distance, there is no fear of decreasing the interpolar distance beyond a limit thereby ensuring a stable operation.

As above described, according to the method of control of this invention, the operation of the electrolytic cell can be stabilized by adjusting the quantity of electric power supplied to the cell in accordance with the result of the detection of the temperature condition of an electrolytic cell made by detecting the variation in the quantity of alumina presenting in the bath or the metal in the solid state. And also according to this invention, as it is possible to accurately and readily determine the temperature condition of an electrolytic cell it becomes possible to maintain the bath temperature at a low value, thus increasing yield of aluminum per unit power consumption.

We claim:

1. A method for controlling an aluminum electrolytic cell comprising the steps of detecting an increase or decrease in the quantity of alumina presenting in the bath or metal in said electrolytic cell in the solid state by calculating the difference between the quantity of alumina supplied to said electrolytic cell during an interval between an instant at which a previous anode effect has occurred or was anticipated to occur and an instant at which a present anode effect occurs or is anticipated to occur, and the quantity of alumina consumed during said interval, and increasing or decreasing the quantity of electric power supplied to said electric cell corresponding to the result of said detection.

2. The method according to claim 1 wherein a deficiency of electric power supplied to said electrolytic cell during an interval between a previous anode effect and a present anode effect which is detected as an increase in the quantity of alumina presenting in the bath or metal in the solid state is compensated for by supplying a surplus of electric power added to the standard quantity of power supply before occurrence of a next anode effect.

3. The method according to claim 2 wherein subsequent to extinguishment of said present anode effect, electric power larger than a quotient obtained by dividing an increased quantity of power supply by an average time between two consecutive anode effect is added to a standard quantity of power supply, and when supply of such surplus power is completed, the quantity of the electric power supply is returned to an original value.

4. The method according to claim 3 wherein said electric power added to said standard quantity of electric power is constant with time.

5. The method according to claim 3 wherein said electric power added to said standard quantity of electric power is large initially and then decreased gradually with time.

6. The method according to claim 1 wherein an increment or decrement per unit time in the quantity of alumina presenting in said bath or a metal in a solid state is determined at each interval between two consecutive anode effects and the sum of a quantity of electric power corresponding to the increment or decrement thus determined and the standard quantity of electric power per unit time is supplied during next interval between two consecutive anode effects.

* * * * *

UNITED STATES PATENT AND TRADEMARK OFFICE

CERTIFICATE OF CORRECTION

PATENT NO. : 4,437,950

DATED : March 20, 1984

INVENTOR(S) : Yoji Arita et al

It is certified that error appears in the above-identified patent and that said Letters Patent is hereby corrected as shown below:

On the title page, Item /73/ Assignee: should read:

--[73] Mitsubishi Keikinzoku Kogyo Kabushiki Kaisha, Tokyo, Japan --

Signed and Sealed this

*Twenty-fourth* Day of *July 1984*

[SEAL]

*Attest:*

GERALD J. MOSSINGHOFF

*Attesting Officer*

*Commissioner of Patents and Trademarks*